United States Patent [19]

Azevedo

[11] 4,230,435

[45] Oct. 28, 1980

[54] BACKHOE FINISHING TOOL

[76] Inventor: Albert J. Azevedo, 1171 Limerick La., Healdsburg, Calif. 95448

[21] Appl. No.: 927,171

[22] Filed: Jul. 21, 1978

[51] Int. Cl.[3] ..... E02F 3/81

[52] U.S. Cl. ..... 414/722; 37/117.5

[58] Field of Search ..... 414/694, 722–724, 414/786; 37/117.5; 172/438

[56] References Cited

U.S. PATENT DOCUMENTS

| | | | |
|---|---|---|---|
| 2,840,931 | 7/1958 | Appel | 37/117.5 |
| 3,109,248 | 11/1963 | Vos | 414/722 X |
| 3,702,712 | 11/1972 | Cairnes | 37/117.5 X |
| 3,778,111 | 12/1973 | Ciofani | 37/117.5 X |
| 3,789,524 | 2/1974 | Mashuda | 414/722 X |
| 4,041,624 | 8/1977 | Fryrear | 414/722 X |

*Primary Examiner*—Stephen G. Kunin
*Assistant Examiner*—Terrance L. Siemens
*Attorney, Agent, or Firm*—Melvin R. Stidham

[57] ABSTRACT

A surface finishing tool for a backhoe comprising a pair of arms which are pivoted on the brackets which extend along the back of the bucket so as to depend therefrom. A scraper of approximately the width of the bracket is welded across the ends of the arms and a stop bar on the arms engages the brackets when the bucket is in its load-carrying position whereby the bucket may be pulled to drag the scraper along the surface. When in the raking or digging positions the arms merely hang down along the back of the bucket with the scraper blade free of engagement with ground.

3 Claims, 3 Drawing Figures

BACKHOE FINISHING TOOL

BACKGROUND OF THE INVENTION

In digging shallow trenches, as for preparing for pouring a concrete walk, it is customary practice to dig a trench to near the desired depth and then use the hoe as a rake to loosen the soil to the final depth. Then a crew of workers take over with shovels to move the soil so loosened and finish the surface. This requires the hiring of additional laborers who are often idle while the backhoe is working, and it often requires that the backhoe be idle while the digging crew is working.

OBJECTS OF THE INVENTION

It is an object of this invention to provide an attachment wherein a shallow trench can be loosened, finished and compacted, all with backhoe operation.

It is a further object of this invention to enable a backhoe operator to scrape and finish a trench without replacing equipment or tools.

It is a further object of this invention to condition a backhoe for compacting and scraping.

Other objects and advantages of this invention will become apparent from the description to follow, particularly when read in conjunction with the accompanying drawings.

SUMMARY OF THE INVENTION

In carrying out this invention, I provide a scraper blade fixed to a pair of arms which may be pivoted in the pivot holes provided in the parallel brackets which extend down the back of the bucket of the backhoe. Normally, the scraper hangs down along the back of the bucket, but when the bucket is pivoted to its load-carrying position it swings away from the depending blade to the extent enabled by a stop bar carried across the arms on the other side of the pivot to limit pivotal movement. In this position, the scraper may be pulled along the surface to scrape and pile soil previously loosened. Hence, in digging a shallow trench, as for pouring concrete, the bucket is pivoted to its raking position and then pulled along the trench to loosen soil. Then, the bucket may be backed up to the starting point and pivoted to its carrying position to activate the scraper blade. After the bucket is pulled the full length of the trench, the dirt pile at the end may be scooped up and removed.

DESCRIPTION OF A PREFERRED EMBODIMENT

Figure 1:
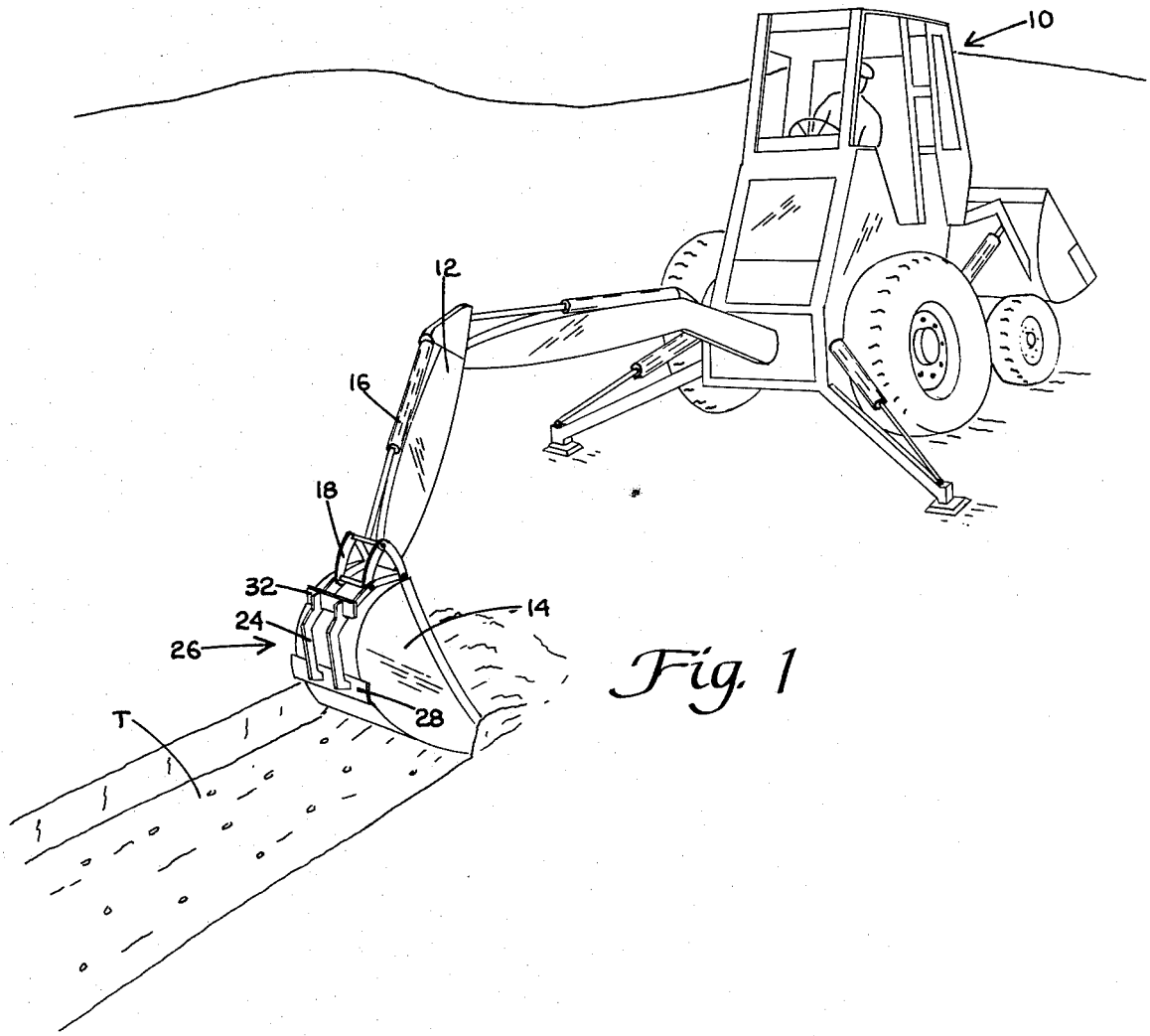
FIG. 1 is a view in perspective of a backhoe in operation.
Figure 2:
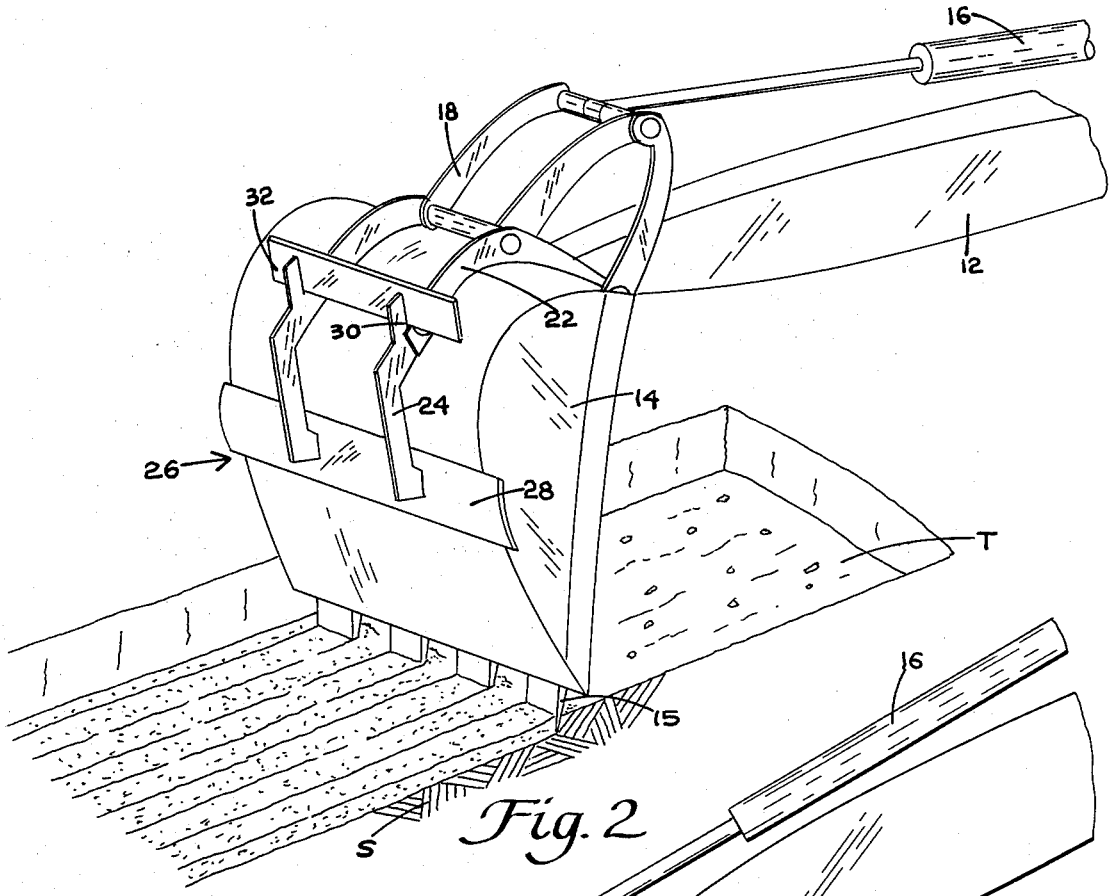
FIG. 2 is a partial view of the backhoe bucket in raking position.

Referring now to the drawings with greater particularity there is shown a backhoe 10 including a boom 12 on the end of which is supported a bucket 14 with a row of teeth 15 along its leading edge or lip. A hydraulic ram 16 extending between the near end of the boom 12 and a linkage 18 carried on the bucket 14 is operative to tilt the bucket for digging as shown in FIG. 1, scraping as shown in FIG. 2 and a carrying position shown in FIG. 3.

Pivotally mounted in the bushings 20 normally provided in the reinforcing brackets 22 which are secured along the back of the bucket 14, are the arms 24 of the surface finisher and compactor 26 of this invention. Welded to the ends of the arms is a scraper or finishing tool 28, which is preferably somewhat concave as illustrated. The arms are free to swing down from the bucket and normally are disposed along the back of the bucket as indicated in FIGS. 1 and 2. However, when the bucket is pivoted upward toward its load carrying position, the scraper finishing tool 28, remaining vertically disposed by gravity, hangs below the uprasied bucket in its operative position shown in FIG. 3. Transverse arms 30 carried on the arm 24 carry a stop bar 32 which engages across the parallel brackets 22 to limit the clockwise swinging of the finishing tool 28, relative to the bucket 14. Since the stop bar 32 is located on the opposite side of the pivotal point 20 from the finishing tool 28, it is carried against the bracket by the relative clockwise movement. Once it is so engaged, the stop bar 32 enables the finishing tool 28 to be dragged over the ground to scrape and further compact the firmer soil below the surface.

Figure 3:
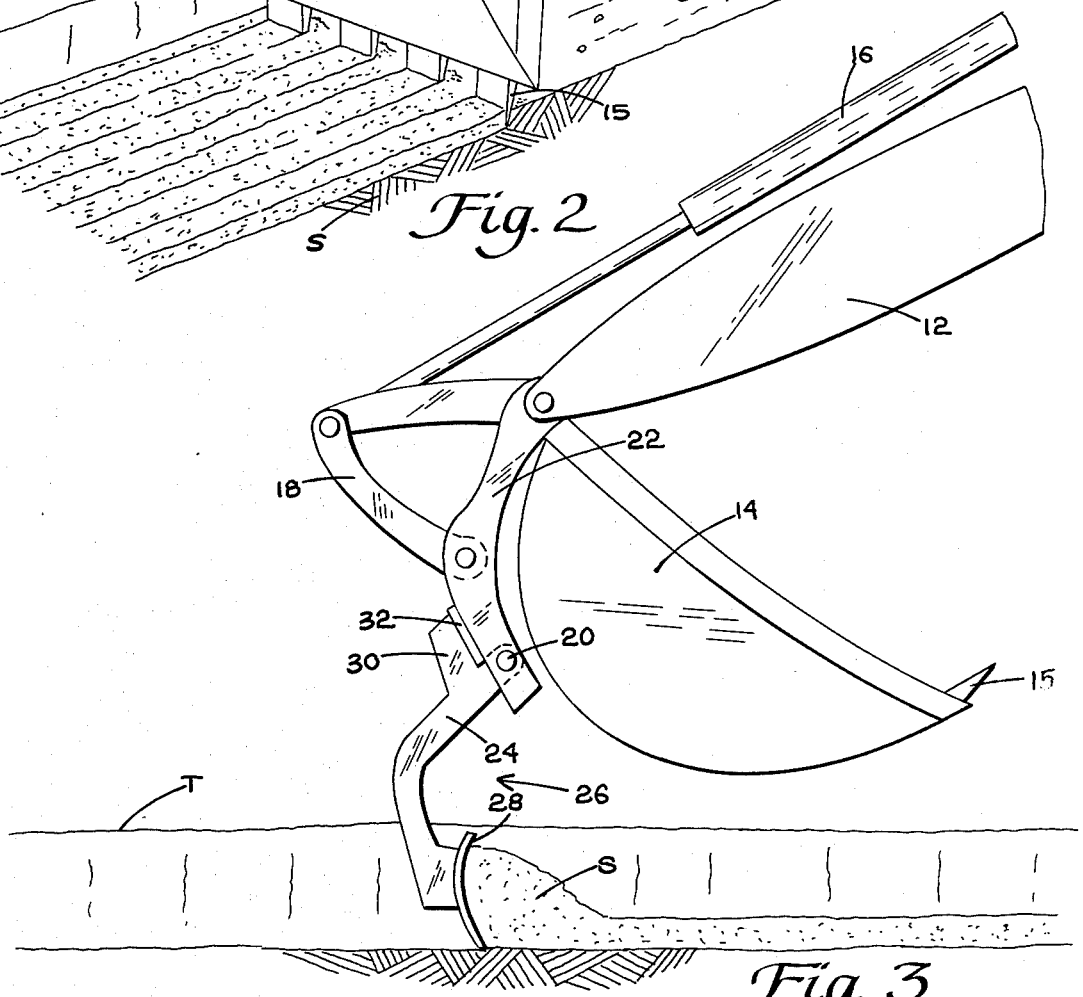
FIG. 3 is a partial view of the bucket in carrying position with the scraper blade activated.

In operation, the backhoe is used to dig a trench T just shallower than the desired depth. Then, the bucket 14 is pivoted to a raking position as shown in FIG. 2 with the teeth 15 in position to penetrate the soil S. Then, the bucket is pulled along the length of the trench to loosen the soil, preparing it for the finishing operation. Finally, as shown in FIG. 3, the bucket is moved to its carrying position, pulling away from the downwardly depending arms 24 until the stop bar 32 is engaged by the backs of the brackets 22. In this position, the bucket may again be pulled along the trench and the soil is piled at the far end of the trench, where it may be removed by normal digging operation of the bucket 14.

While this invention has been described in conjunction with a preferred embodiment thereof, it is obvious that modifications and changes therein may be made by those skilled in the art without departing from the spirit and scope of this invention, as defined by the claims appended hereto.

What I claim as invention is:

1. In combination with a backhoe including:

a boom;

a bucket pivotally mounted on the end of said boom;

a row of teeth along the lip of said bucket;

a pair of generally parallel brackets along the back of said bucket;

a pair of links connecting said bracket and said boom; and hydraulic means connecting said boom and said links for tilting said bucket between a raking position with the ends of said teeth disposed downwardly, digging position with said teeth disposed downwardly and in the direction of said boom, and a carrying position with said teeth disposed upwardly;

a surface finisher means for scraping and leveling a trench comprising:

an arm pivoted on said brackets to depend therefrom;

a scraper of approximately the width of said bucket and having a blunt, flat bottom edge fixed on the end of said arm; and stop means on said arm to limit pivotal movement thereof away from said bucket when in said carrying position.

2. The combination defined by claim 1 wherein:

there are a pair of arms pivoted in said brackets; and said scraper is secured across said arms.

3. The combination defined by claim 2 including:

an extension on each of said arms to the opposite side of the pivotal axis thereof;

a stop bar welded across said extension engagable across brackets when said bucket is in said carrying position.

* * * * *